US005238086A

United States Patent [19]

Aoki et al.

[11] Patent Number: 5,238,086

[45] Date of Patent: Aug. 24, 1993

[54] CONTROL DEVICE FOR FORKLIFT

[75] Inventors: Kanji Aoki; Yukio Uchiyama; Toshiyuki Midorikawa, all of Sagamihara, Japan

[73] Assignees: Mitsubishi Jukogyo Kabushiki Kaisha, Tokyo; MHI Sagami High Technology & Control Engineering Co., Kanagawa, both of Japan

[21] Appl. No.: 853,070

[22] Filed: Mar. 17, 1992

[30] Foreign Application Priority Data

Apr. 1, 1991 [JP] Japan ..... 3-68528

[51] Int. Cl.[5] ..... B66B 9/20

[52] U.S. Cl. ..... 187/9 R; 414/630

[58] Field of Search ..... 187/9 E, 9 R; 414/630, 414/631; 91/189

[56] References Cited

U.S. PATENT DOCUMENTS 2,554,930 5/1951 Ulinski ..... 214/113
3,107,750 10/1963 Bishop ..... 187/9 E
4,130,183 12/1978 Tjörnemark ..... 187/9 R

FOREIGN PATENT DOCUMENTS 1174262 7/1964 Fed. Rep. of Germany .
1456892 1/1969 Fed. Rep. of Germany .
1571083 5/1968 France .
107405 7/1985 Japan .
2093217A 2/1981 United Kingdom .
2099184 3/1982 United Kingdom .

OTHER PUBLICATIONS

European Search Report.

*Primary Examiner*—Robert P. Olszewski
*Assistant Examiner*—Kenneth Noland
*Attorney, Agent, or Firm*—Nixon & Vanderhye

[57] ABSTRACT

On a forklift equipped with a full free lift mast, a limit switch for detecting the maximum free lift of fork on an inner mast is installed in such a manner when the limit switch is turned on, the raising control of fork is stopped, by which a collision between the inner mast and the ceiling is prevented.

5 Claims, 6 Drawing Sheets

CONTROL DEVICE FOR FORKLIFT

FIELD OF THE INVENTION AND RELATED ART STATEMENT

This invention relates to a control device for forklift which electrohydraulically performs cargo handling and more particularly the improvement of device for assuring safety in operation.

As the conventional control device for forklift operated electrohydraulically, for example, a device shown in FIG. 5 is known (refer to Japanese Utility Model Provisional Publication No. 107405/1985).

As shown in FIG. 5, the oil pressure from a hydraulic pump 101 is distributed to an electromagnetic proportional control valve 102 and a control valve for power steering (not shown). In the electromagnetic proportional control valve 102, an oil chamber 102*a* for pilot operation is formed, and a pilot piston 102*b* is slidably fitted to the oil chamber 102*a*. The pilot piston 102*b* is connected to a spool 102*c* which changes over the oil passage. The pilot piston 102*b* and the spool 102*c*, which are connected to a spring 103*a*, 103*b*, respectively, are kept in the neutral position when oil pressure is not applied. At each side of the pilot piston 102*b*, pilot inflow pipes 102*d*, 102*e* are provided. The pilot inflow pipes 102*d*, 102*e* are connected to a hydraulic system for power steering via an electromagnetic opening/closing valve 102*f*, 102*g*. Therefore, the pilot piston 102*b* and spool 102*c* move to the right or left in the figure by opening or closing the electromagnetic opening/closing valve 102*f*, 102*g*. When the spool 102*c* moves, pressure oil is supplied to or discharged from the work machine cylinder 104 via the spool 102*c*, by which the work machine cylinder 104 is extended or retracted. The position to which the spool 102*c* moves regulates the rate of flow of pressure oil supplied to or discharged from the work machine cylinder 104, and in turn regulates the raising/lowering speed thereof. As the work machine cylinder 104, various types of cylinders may be used such as a lift cylinder for raising/lowering a fork (not shown) along a mast or a tilt cylinder for tilting the mast.

The opening/closing of the electromagnetic opening/closing valve 102*f*, 102*g* is controlled by the flow control signal sent from a controller 105. The controller 105 outputs a flow control signal in accordance with the lever operation signal sent from a work machine lever 106. The work machine lever 106, provided with a potentiometer, outputs lever operation signals in accordance with the inclination angle and direction of the lever. The work machine lever 106 does not output a signal when it is in the neutral position.

Thus, the operation of work machine lever 106 opens or closes the electromagnetic opening/closing valve 102*f*, 102*g*, by which pressure oil is supplied to or discharged from the work machine cylinder 104 through the electromagnetic proportional control valve 102 to extend or retract the work machine cylinder 104 for lifting or tilting the fork. When the inclination angle of work machine lever 106 is controlled, the rate of flow of pressure oil sent to the work machine cylinder 104 is controlled, so that the raising/lowering speed can be arbitrarily controlled.

For most forklifts, a full free lift mast has been used to attain the maximum lift of fork. For this full free lift mast, as shown in FIG. 6, an inner mast 3 is fitted, in a vertically slidable manner, to an outer mast 2, which has a second lift cylinder 1, and the top end of a piston rod 1*a* is connected to the top end of the inner mast 3. Therefore, when the second lift cylinder 1 is hydraulically extended or retracted, the inner mast 3 moves vertically in relation to the outer mast 2. To the inner mast 3 is slidably assembled a raising/lowering portion consisting of a fork 4 and the like, and a first lift cylinder 24 is incorporated in the inner mast 3. A pulley 25 is attached to the top end of piston rod 24*a* of the first lift cylinder 24. A chain 26 whose one end is connected to the fork 4 is set around the pulley 25, and the other end of chain 26 is secured to the inner mast 3. Therefore, by vertically moving the pulley 25 at the top end of piston rod 24*a* by hydraulically extending or retracting the first lift cylinder 24, the fork 4 can be raised or lowered in relation to the inner mast 3 via the chain 26. The lift height of fork on the inner mast, namely, the lift height excluding the lift height by the outer mast 2, is called a free lift height. The outer mast 2 is tiltably attached to the vehicle body so as to be tilted forward or backward by a not illustrated tilt cylinder.

Since the oil chambers of the first lift cylinder 24 and second lift cylinder 1 communicate with each other, these lift cylinders operate in relation to each other. However, they always extend hydraulically in the order of the first lift cylinder and the second lift cylinder because of the difference in area which receives the pressure. When a oil pressure is applied for raising the fork 4, the first lift cylinder 24 extends first, raising the fork 4 along the inner mast 3. When the fork 4 rises to the top end of inner mast 3 and the first lift cylinder does not extend further, the oil pressure increases. Therefore, the second lift cylinder 1 extends so that the inner mast 3 rises in relation to the outer mast 2. Inversely, when the fork is lowered, the lift cylinders retract in the order of the second lift cylinder and the first lift cylinder.

Since the maximum lift of fork on the forklift equipped with such a full free lift mast is of two-stage type in which the lift of fork on the inner mast 3 is added to the lift of the inner mast 3 along the outer mast 2, the forklift of this type is suitable for the operation at heights. However, it is sometimes used at a place where the ceiling height is limited, for example, in a container.

When a forklift having the full free lift mast is used at a place where the ceiling height is limited, there is a risk that the inner mast 3 is raised inadvertently along the outer mast 2, causing a collision of the inner mast 3 with the ceiling. This collision causes not only damage to the ceiling but also danger of falling of cargos being handled. To prevent the collision, the operator checks visually whether the fork 4 is within the free lift range. However, there is a problem of operator's mistake in judgement and significant decrease in checking accuracy caused by fatigue.

OBJECT AND SUMMARY OF THE INVENTION

It is an object of the present invention to provide a method in which, in controlling a forklift which has a full free lift mast and performs cargo handling work electrohydraulically, operations can be performed safely even at a place having a low ceiling by raising a fork within the free lift height.

In other words, it is an object of the present invention to provide a method for controlling a forklift equipped with a full free lift mast which raises and lowers a fork in two stages to prevent a collision of the inner mast with the ceiling.

In the first constitution of this invention to attain the above object, on a forklift including a controller for outputting a flow control signal to an electromagnetic proportional control valve in response to a lever operation signal sent from a work machine lever, an electromagnetic proportional control valve for supplying/discharging pressure oil corresponding to the flow control signal from the controller to/from a first lift cylinder and a second lift cylinder, and a full free lift mast having the first lift cylinder for raising/lowering a fork in relation to an inner mast by means of the pressure oil supplied from the electromagnetic proportional control valve and the second lift cylinder for raising/lowering the inner mast in relation to an outer mast, a control device for forklift has a limit switch for detecting the maximum free lift, the upper limit position of the fork on the inner mast, and the controller includes a means for outputting a flow control signal to the electromagnetic proportional control valve to shut down the supply of pressure oil to the lift cylinders when the limit switch detects the maximum free lift.

In the second constitution of this invention to attain the above object, on a forklift including a controller for outputting a flow control signal to an electromagnetic proportional control valve in response to a lever operation signal sent from a work machine lever, an electromagnetic proportional control valve for supplying/discharging pressure oil corresponding to the flow control signal from the controller to/from a first lift cylinder and a second lift cylinder, and a full free lift mast having the first lift cylinder for raising/lowering a fork in relation to an inner mast by means of the pressure oil supplied from the electromagnetic proportional control valve and the second lift cylinder for raising/lowering the inner mast in relation to an outer mast, a control device for forklift has a limit switch for detecting a position lower than the maximum free lift, the upper limit position of the fork on the inner mast, and the controller includes a means for outputting a flow control signal to the electromagnetic proportional valve to decelerate the supply of pressure oil to the lift cylinders for a certain time and then shut down the supply of oil when the limit switch detects the position lower than the maximum free lift.

According to the first constitution of this invention, when the limit switch is turned on and the maximum free lift is detected, the supply of pressure oil from the electromagnetic proportional control valve to the lift cylinders is shut down. Therefore, the inner mast does not rise along the outer mast, which prevents the damage to the ceiling and the accident caused by falling cargos.

According to the second constitution of this invention, the fork is stopped gradually at the maximum free lift position, which provides better operation feeling.

DETAILED DESCRIPTION OF PREFERRED EMBODIMENTS

A control device for forklift according to this invention will be described in detail with reference to an embodiment shown in drawings.

Figure 1:
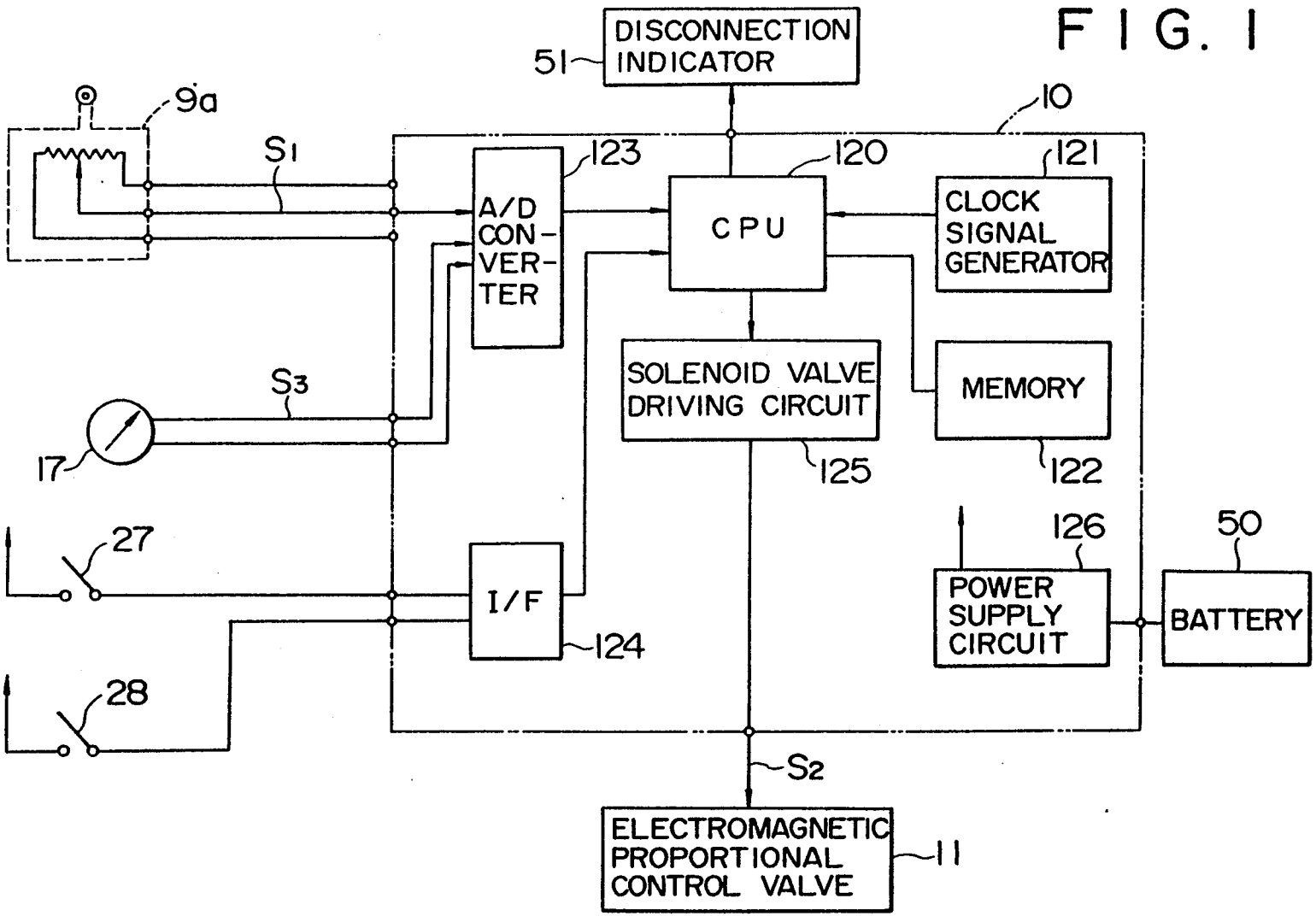
FIG. 1 is a block diagram illustrating the main portion of a control device for forklift according to an embodiment of this invention.
Figure 2:
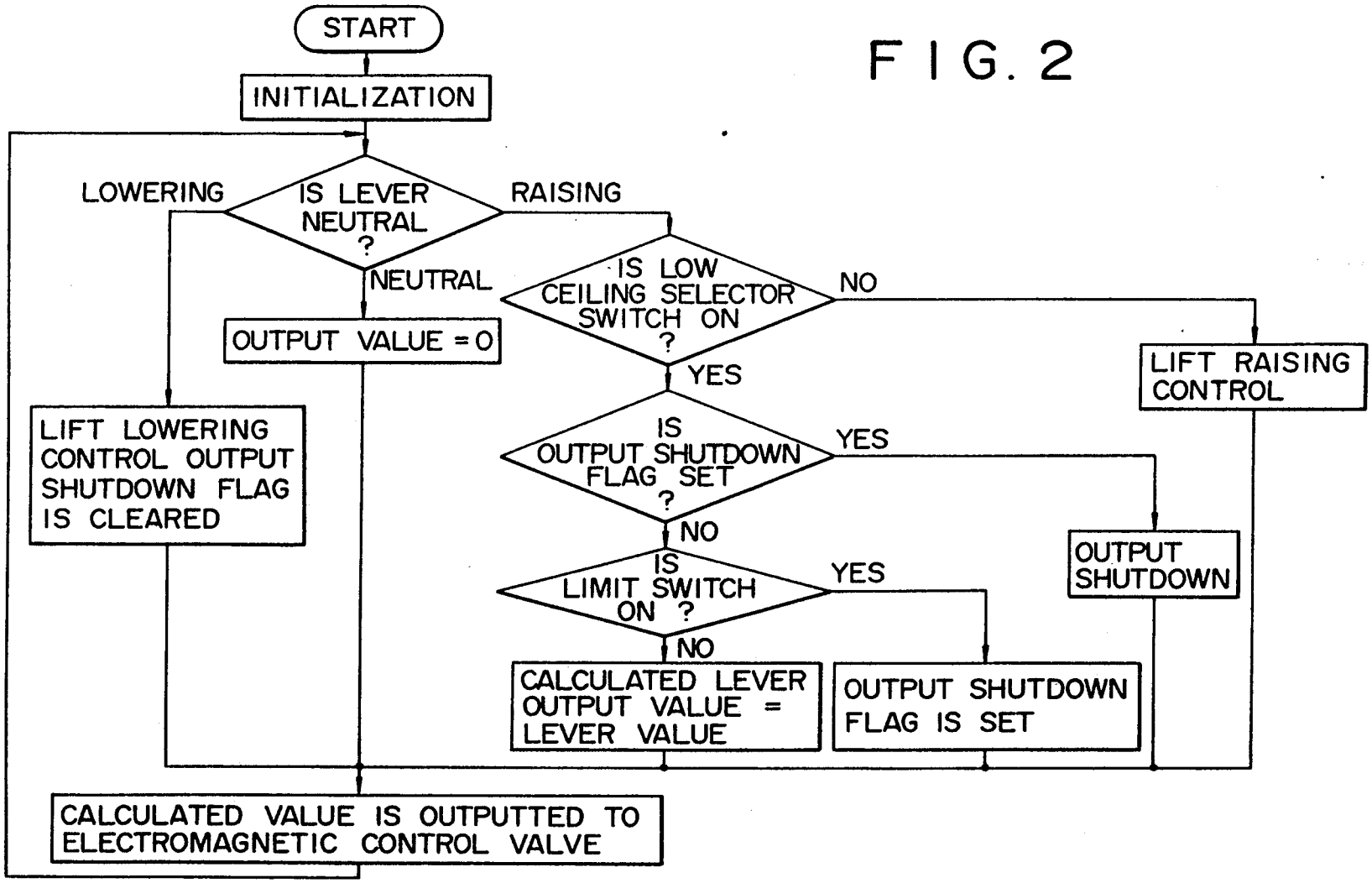
FIG. 2 is a flowchart of a process for an embodiment of this invention.
Figure 3:
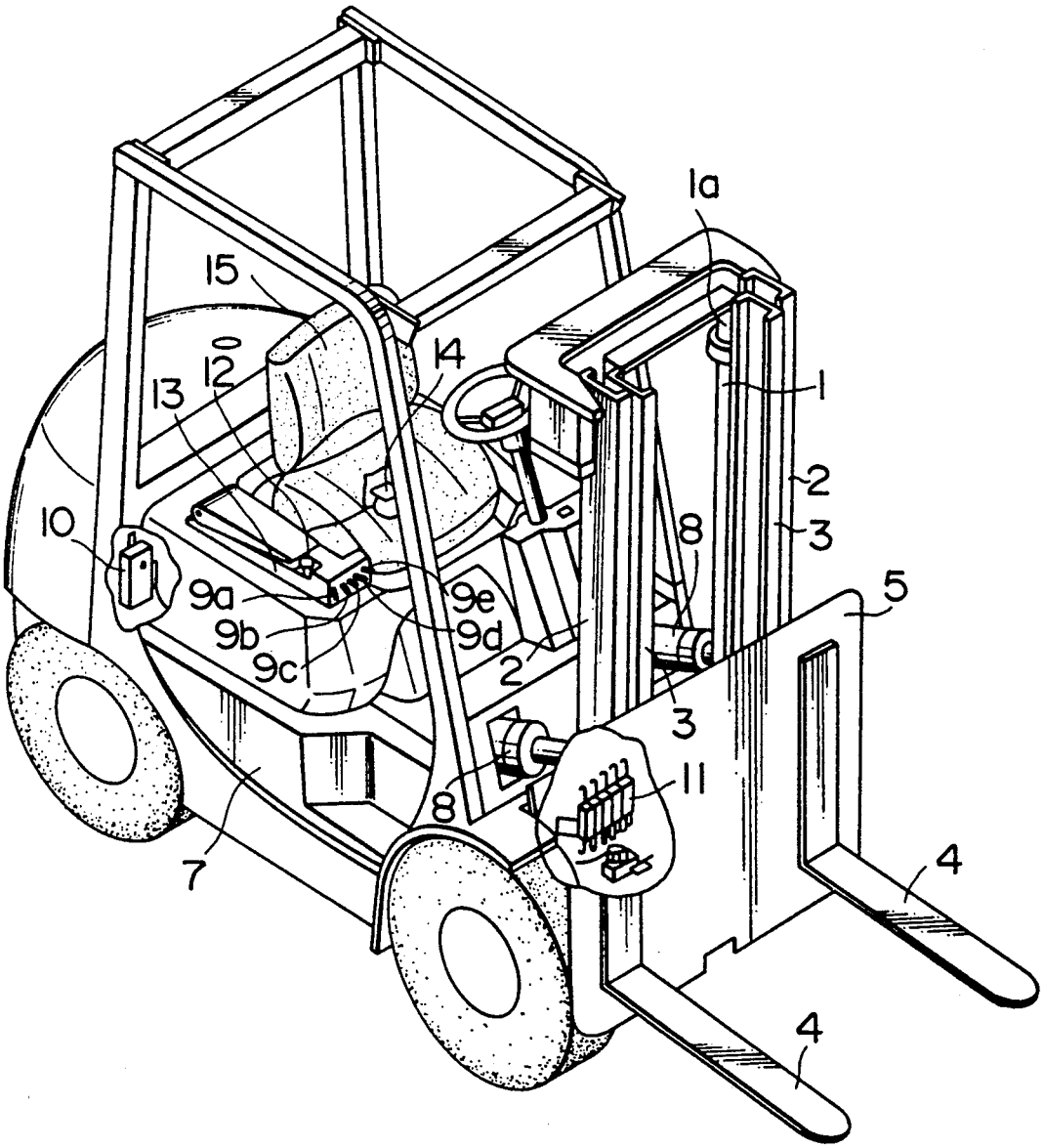
FIG. 3 is a perspective view of a forklift in which this invention is carried out.
Figure 6C:
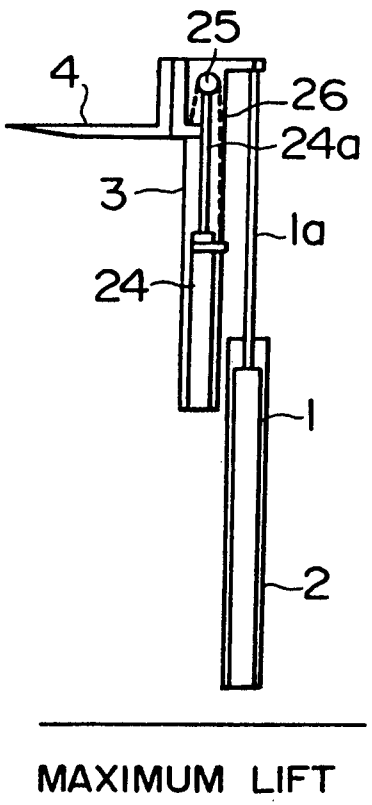
FIG. 6(c) PRIOR ART
FIG. 6 is a schematic view of the construction of a full free lift mast, illustrating the fork on the ground (a), the maximum free lift (b), and the maximum lift (c).
Figure 6B:
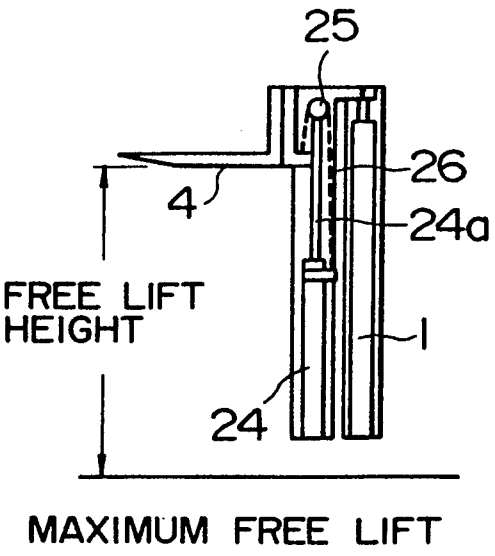
FIG. 6(b) PRIOR ART
Figure 6A:
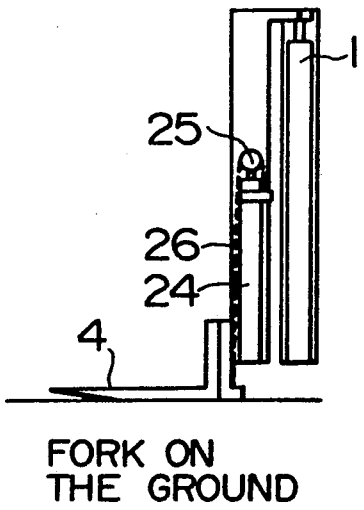
FIG. 6(a) PRIOR ART

FIGS. 1 through 4 show an embodiment of this invention. FIG. 3 is a perspective view of a forklift in which this invention is carried out. In FIG. 3, the full free lift mast of forklift is constructed as shown in FIG. 6, though a part thereof is simplified in FIG. 3. Inner masts 3 are slidably attached to a pair of right and left outer masts, and each of the outer masts has a second cylinder 1. A piston rod 1*a* of the second lift cylinder 1 is connected to the top end of an inner mast 3, so that the inner mast 3 moves vertically in relation to the outer mast 2 when oil pressure is applied to the second lift cylinder 1. A raising/lowering portion consisting of a bracket 5 and forks 4 is carried on the inner masts 3 in a vertically slidable manner, and the inner mast 3 incorporates a first lift cylinder 24. A pulley 25 is attached to the top end of piston rod 24*a* of the first lift cylinder 24. A chain 26 whose one end is attached to the bracket 5 and the forks 4 is set around the pulley 25, and the other end of chain 26 is secured to the inner mast 3; the bracket 5 and the forks 4 are suspended by the chain. Therefore, by vertically moving the pulley 25 at the top end of piston rod 24*a* by hydraulically extending or retracting the first lift cylinder 24, the bracket 5 and the forks 4 can be raised or lowered in relation to the inner mast 3 via the chain 26. At the top end of the inner mast 3, a limit switch 27 is installed to detect the maximum free lift, which is the upper limit of fork 4 on the inner mast 3, though it is omitted in FIG. 3. The outer masts 2 are attached to a vehicle body 7 in a longitudinally tiltable manner, so that it can be tilted forward or backward from the vertical position with tilt cylinders 8. Therefore, in unloading, the tips of forks can be lowered by tilting the outer masts forward, whereas in loading and transporting cargos, the tips of forks are raised for assuring better workability and greater safety by tilting the outer masts 2 backward.

The work machine levers 9*a*, 9*b* control the operation of the first lift cylinders 24, the second lift cylinders 1, and the tilt cylinders 8 via a controller 10 and an electromagnetic proportional control valve 11 when being operated by the operator. The levers are housed in a joy stick box 13 together with a safety switch 12 for performing emergency shutdown. The work machine levers 9*c*, 9*d*, 9*e* are used when various attachments are installed, such as a roll clamp and a bale clamp. The seat switch 14 is activated when the operator sits on an operator's seat 15. The output signal of the seat switch 14 is sent to the controller 10.

Figure 4:
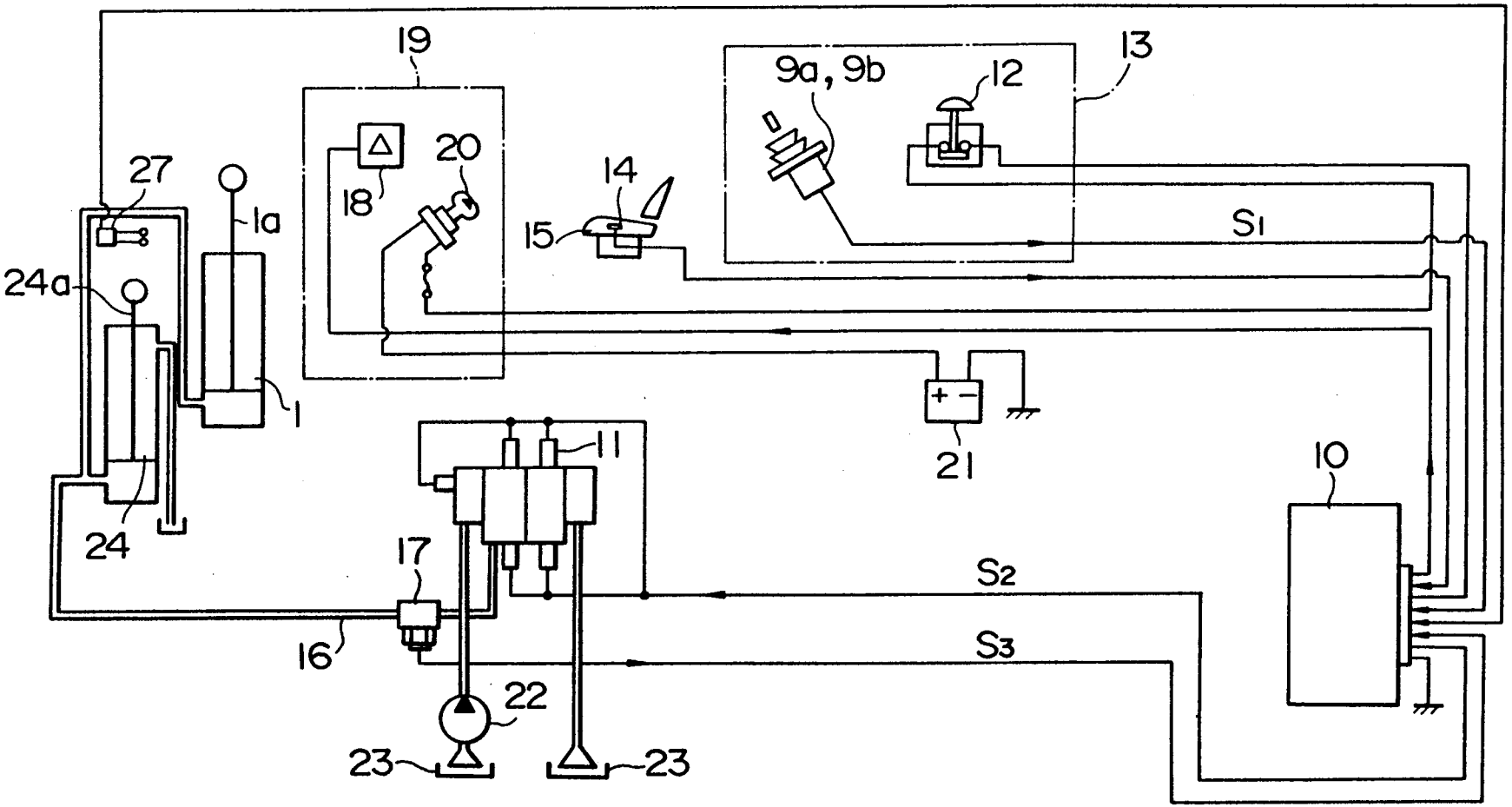
FIG. 4 is a diagrammatic view showing the entire constitution of control device for forklift according to an embodiment of this invention.
Figure 5:
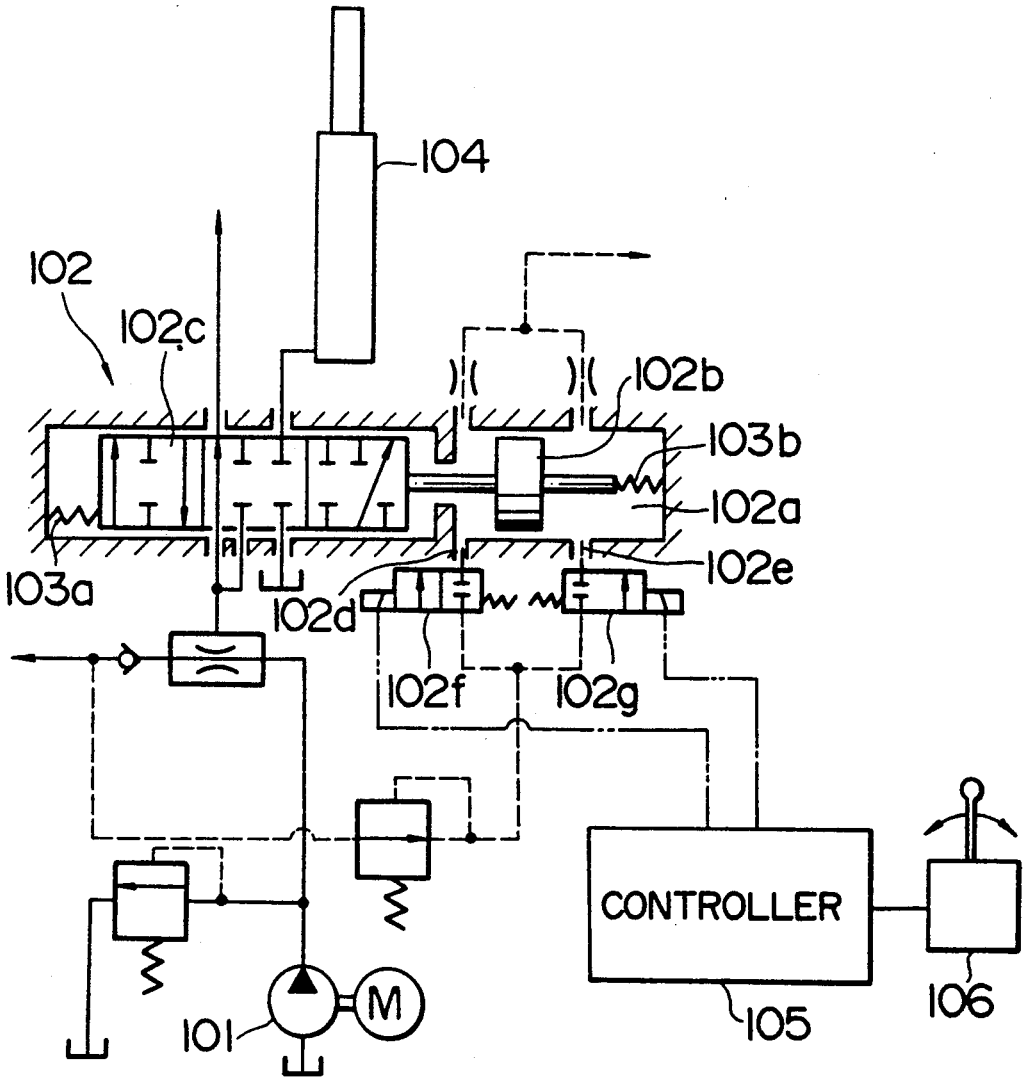
FIG. 5 PRIOR ART
FIG. 5 is a schematic view of a conventional control device for forklift.

FIG. 4 is a diagrammatic view of the control device of the above-described forklift. The work machine lever 9*a*, 9*b*, which is formed by a potentiometer, sends a lever operation signal $S_1$, the current of which is proportional to the lever operating stroke. The controller 10 sends a flow control signal $S_2$ for controlling the degree of opening of spool of the electromagnetic proportional control valve 11 in accordance with the lever operation signal $S_1$. The electromagnetic proportional control valve 11 moves the spool in proportion to the magnitude of flow control signal $S_2$ so as to control the rate of flow of pressure oil flowing a pressure oil pipe 16, thereby controlling the operating speeds of the first lift cylinder 24, the second lift cylinder 1, and the tilt cylinder 8 so that they correspond to the lever operating stroke of work machine lever 9*a*, 9*b*. Since the oil chambers of the first lift cylinder 24 and second lift cylinder 1 communicate with each other, these lift cylinders operate in relation to each other. However, the first lift cylinder 24 always extends first, and then the second lift cylinder extends because of the difference in area which receives the pressure. The retraction is performed in the reverse order.

An oil pressure sensor 17, which is disposed in the pressure oil pipe 16, sends an oil pressure signal $S_3$ representing the oil pressure in the pressure oil pipe 16. The controller 10 processes the oil pressure signal $S_3$, and calculates the load acting on the lift cylinder 1 and tilt cylinder 8.

The controller 10 is operated by the power supplied from a battery 21 when a starter switch 20, which is housed in a console box 19 together with a warning light 18, is operated. When the safety switch 12 is activated or when the seat switch is not turned on because the operator's seat is vacant, the controller 10 operates in such a manner that the current of flow control signal $S_2$ becomes zero and in turn the degree of opening of the electromagnetic proportional control valve 11 becomes zero.

In FIG. 4, reference numeral 22 denotes a hydraulic pump, and 23 denotes a hydraulic oil source. The hydraulic components such as the electromagnetic proportional control valve 11, the pressure oil pipe 16, and the oil pressure sensor 17 are installed so that the number of them corresponds to the number of work machine levers 9*a* through 9*e*. In this embodiment, two hydraulic systems may be installed since the control system has two work machine levers 9*a*, 9*b* for raising/lowering and tilting operations.

FIG. 1 is a block diagram illustrating the main portion of a control device for forklift according to an embodiment of this invention. The controller 10, as shown in FIG. 1, includes a CPU 120, a clock signal generator 121, memory 122, an A/D converter 123, an interface 124, a solenoid valve driving circuit 125, and a power supply circuit 126 operated by a battery 50. The lever operation signal $S_1$ outputted from the work machine lever 9*a* and the oil pressure signal $S_3$ outputted from the oil pressure sensor 17 are converted into a digital signal by the A/D converter 123, and then the digital signal is sent to the CPU 120. The signal generated by the operation of a limit switch 27 or a low ceiling selector switch 28 is sent to the CPU 120 via the interface 124. The low ceiling selector switch is a switch which is turned on when the ceiling is low. The CPU 120 performs various operations by using the functions described in various software stored in the memory 122. The operation of the CPU 120 synchronizes with the clock signal of the clock signal generator 121. Based on the operation result of the CPU 120, the solenoid valve driving circuit 125 is driven, so that the flow control signal $S_2$ is outputted to the electromagnetic proportional control valve 11.

When the low ceiling selector switch 28 is turned on and the work machine lever 9*a* is operated for raising, the CPU 120 outputs the flow control signal $S_2$ for supplying pressure oil to the first lift cylinder 24 and the second lift cylinder 1 to the electromagnetic proportional control valve 11 until the limit switch 27 is turned on. The first lift cylinder 24 is extended by the pressure oil supplied from the flow control valve 11 in accordance with the flow control signal $S_2$, by which the fork 4 is raised.

After that, when the upper limit of the fork 4 on the inner mast 3, namely the maximum free lift shown in FIG. 6, is reached and the limit switch 27 is turned on, the CPU 120 outputs the flow control signal $S_2$ for stopping the supply of pressure oil to the first lift cylinder 24 and the second lift cylinder 1 to the electromagnetic proportional control valve 11. Therefore, the inner mast 3 does not rise along the outer mast 2, preventing the damage to the ceiling and the accident caused by falling cargos.

When the low ceiling selector switch 28 is turned off and the work machine lever 9*a* is operated for raising, the CPU 120 outputs the flow control signal $S_2$ for supplying pressure oil to the first lift cylinder 24 and the second lift cylinder 1 to the electromagnetic proportional control valve 11. Therefore, the first lift cylinder 24 and the second lift cylinder 1 extend, so that the fork 4 rises to the maximum lift shown in FIG. 6(*c*). At this time, the activation of the limit switch 27 is neglected.

In this embodiment having the above-described constitution, the forklift is controlled in accordance with the flowchart shown in FIG. 2.

After the initialization is performed first, a decision is made on whether the work machine lever 9*a*, 9*b* is in the neutral position or not. When the work machine lever 9*a*, 9*b* is in the neutral position, the output value to the electromagnetic proportional control valve 11 is zero, and the neutral control is carried out to keep the fork 4 at a constant height. When the work machine lever 9*a*, 9*b* is pushed away from the neutral position, the raising control for raising the fork or the lowering control for lowering the fork is carried out. For the raising control, a decision on whether the low ceiling selector switch 28 is in the ON position or not. When the low ceiling selector switch 28 is in the ON position, a check is made to ensure that the output shutdown flag is not set. Then, the flow control signal of output value corresponding to the lever operating stroke of the work machine lever 9*a*, 9*b* is outputted to the electromagnetic proportional control valve 11.

If the limit switch 27 is turned on, and the maximum free lift height is detected as shown in FIG. 6(*b*), the output shutdown flag is set. On verifying that the output shutdown flag is set, the output of flow control signal to the electromagnetic proportional control valve 11 is shut down.

When the low ceiling selector switch 28 is in the OFF position, the usual raising control is carried out; the fork 4 is raised up to the maximum lift height shown in FIG. 6(*c*) by the extension of the first lift cylinder 24 and the second lift cylinder 1.

If the control for decreasing the lifting speed of fork 4 is carried out after the output shutdown flag is set and before the output shutdown is outputted, the fork 4 stops gradually at the maximum free lift position, which offers an advantage of better operation feeling. In this case, the limit switch 27 must detect a position lower than the maximum free lift height.

In this embodiment, if the low ceiling selector switch 28 is turned on when work is done at a place where the ceiling is relatively low, for example in a container, the inner mast 3 does not rise along the outer mast 2, which surely prevents the damage to the ceiling and the accident caused by falling cargos.

As described in detail according to an embodiment, the control device of this invention detects the upper limit of free lift with a limit switch and shuts down the output in controlling a forklift which has a full free lift mast and performs cargo handling work electrohydraulically. Therefore, the control device of this invention offers an advantage of greater safety in operation at a place having a low ceiling because the fork is raised and lowered only within the range of free lift.

We claim:

1. In a forklift including a controller for outputting a flow control signal to an electromagnetic proportional control valve in response to a lever operation signal sent from a work machine lever, an electromagnetic proportional control valve for supplying/discharging pressure oil corresponding to the flow control signal from said controller to/from a first lift cylinder and a second lift cylinder, and a full free lift mast having the first lift cylinder for raising/lowering a fork in relation to an inner mast by means of the pressure oil supplied from said electromagnetic proportional control valve and the second lift cylinder for raising/lowering said inner mast in relation to an outer mast, a control device for forklift having a limit switch for detecting the maximum free lift, the upper limit position of said fork on said inner mast, said controller including a means for outputting a flow control signal to said electromagnetic proportional control valve to shut down the supply of pressure oil to said lift cylinders when said limit switch detects said maximum free lift, wherein a low ceiling selector switch is installed in such a manner that when said low ceiling selector switch is in the ON position, the supply of pressure oil from said electromagnetic proportional control valve to said lift cylinders is shut down when said limit switch is turned on, and when said low ceiling selector switch is in the OFF position, said fork is raised up to the maximum lift height beyond the free lift height by the raising operation of said work machine lever when said limit switch is in either ON or OFF position.

2. In a forklift including:

a controller for outputting a flow control signal to an electromagnetic proportional control valve in response to a lever operation signal sent from a work machine lever, an electromagnetic proportional control valve for supplying/discharging pressure oil corresponding to the flow control signal from said controller to/from a first lift cylinder and a second lift cylinder, and a full free lift mast having the first lift cylinder for raising/lowering a fork in relation to an inner mast by means of the pressure oil supplied from said electromagnetic proportional control valve and the second lift cylinder for raising/lowering said inner mast in relation to an outer mast:

a control device for said forklift having a limit switch for detecting a position lower than the maximum free lift, the upper limit position of said fork on said inner mast, said controller including a means for outputting a flow control signal to said electromagnetic proportional control valve to decelerate the supply of pressure oil to said lift cylinders for a certain time and then shut down the supply of oil when said limit switch detects said position lower than the maximum free lift.

3. A forklift, said forklift including:

a first lift cylinder;

a second lift cylinder;

a controller for outputting a flow control signal to an electromagnetic proportional control valve, said flow control signal corresponding to movement of a forklift control lever;

an electromagnetic proportional control valve for supplying to and discharging from said first and second lift cylinders pressurized oil in a volume corresponding to said flow control signal from said controller; and a full free mast including inner and outer masts, said first lift cylinder for raising and lower a fork relative to said inner mast by means of said pressurized oil supplied from said electromagnetic proportional control valve and said second lift cylinder for raising and lowering said inner mast relative to said outer mast by means of pressurized oil supplied from said electromagnetic proportional control valve, said full free mast including means for ensuring said first lift cylinder is fully extended before said second lift cylinder is extended, wherein said controller includes:

a low ceiling selector switch having "on" and "off" positions;

a limit switch for detecting at least the approach of the maximum free lift as the upper limit of said fork on said inner mast; and means for outputting a flow control signal to said electromagnetic proportional valve for terminating the supply of pressurized oil to said lift cylinders when said maximum free lift is detected by said limit switch and said low ceiling selector switch is an "on" position.

4. A forklift according to claim 3, wherein each of said lift cylinders has a working area against which pressurized oil is applied generating a lifting force for the cylinder, wherein said means for ensuring comprises providing said first cylinder with a larger effective pressurized area than said second cylinder and wherein said pressurized oil is applied to both lift cylinders simultaneously.

5. A forklift according to claim 4, wherein said limit switch is not located at the upper limit of said fork on said inner mast and said means for outputting a flow control signal provides a flow control signal for terminating said supply of pressurized oil in a gradually decreasing manner.

* * * * *